United States Patent [19]

Tepper

[11] 4,148,486

[45] Apr. 10, 1979

[54] PINBALL TOY WITH BALL EJECTOR

[76] Inventor: Sidney Tepper, 24 Edgewood Ter., Millburn, N.J. 07041

[21] Appl. No.: 854,187

[22] Filed: Nov. 23, 1977

[51] Int. Cl.[2] ..... A63B 63/04; A63D 13/00; A63F 7/02

[52] U.S. Cl. ..... 273/121 R; 273/124 R; 273/127 C; 273/129 GA

[58] Field of Search ..... 273/121 R, 119 R, 119 A, 273/121 A, 123 A, 123 R, 127 R, 127 C, 124 R, 124 A, 121 E, 125 R, 125 A, 122 R, 122 A, 102.1, 34 A

[56] References Cited

U.S. PATENT DOCUMENTS

| | | | |
|---|---|---|---|
| 1,826,641 | 10/1931 | Waddell | 273/34 A |
| 2,139,783 | 12/1938 | Van Tuyl | 273/129 GA |
| 2,317,506 | 4/1943 | Williams et al. | 273/123 A |
| 3,901,511 | 8/1975 | Garbark | 273/119 A |
| 3,920,245 | 11/1975 | Gothreaux et al. | 273/127 C |
| 3,975,019 | 8/1976 | Barlow | 273/127 R |
| 4,065,129 | 12/1977 | Bartok | 273/121 A |

FOREIGN PATENT DOCUMENTS

| | | | |
|---|---|---|---|
| B26642 | 2/1956 | Fed. Rep. of Germany | 273/121 A |
| 1154600 | 4/1958 | France | 273/121 A |

OTHER PUBLICATIONS

Advertisement from "Playthings" received by PTO, 2/22/77.

*Primary Examiner*—Richard C. Pinkham
*Assistant Examiner*—Lawrence E. Anderson
*Attorney, Agent, or Firm*—Alan H. Levine

[57] ABSTRACT

A pinball toy including an inclined playing surface having a plurality of holes through which a ball rolling on the playing surface can fall. Beneath each hole is a ball-ejecting member spring biased upwardly but held down by a latch. As a ball falls through a hole, the ball operates a latch release allowing the spring to pop the ball-ejector upwardly through the hole so as to push the ball upwardly through the hole and back on to the playing surface. Each latch release operates independently only in response to a ball falling through its respective hole, and a manually operated member is provided to simultaneously depress all the ball-ejectors to their latched down positions. A striker carried by each latch hits a bell each time the latch is released. Flippers in the lower region of the playing surface are pivotally movable in a plane parallel to the playing surface in response to moving a flipper actuator toward the playing surface.

10 Claims, 10 Drawing Figures

PINBALL TOY WITH BALL EJECTOR

This invention relates to a pinball toy reminiscent of the well-known pinball machine in which balls, one at a time, are propelled to the highest point of a sloped playing surface and made to rebound on bumpers and drop into holes in order to score points. Commercial pinball machines are relatively complicated electrically-operated devices, requiring a degree of skill to play, which lights up and makes sounds as points are scored, the score being automatically and continuously tallied on an upstanding illuminated board at the rear of the playing surface.

It is an object of the present invention to provide a much simpler, non-electric pinball toy for use by young children not yet old enough to have the physical size, the skill, or the hand manipulation ability required to play with a pinball machine. Such children are generally in the age catagory of three to eight years.

It is another object of the invention to provide such a toy wherein when a ball rolling on the inclined playing surface falls through a hole in the surface, it is returned to the playing surface by a ball-ejecting member beneath each hole which rises upwardly through the hole.

It is a further object of the invention to provide such a toy wherein the ball-ejecting member, after returning a ball to the playing surface, remains in the hole projecting above the playing surface so as to prevent the ball from again entering the same hole, and also serve as a bumper, thereby helping the child to cause the ball in play to enter as many holes as possible.

It is an additional object of the invention to provide such a toy wherein each ball-ejecting member is spring biased upwardly and latched down in a position below the playing surface, the latch being released by the ball as it falls through the hole.

Another object of the invention is the provision of a manually movable device for simultaneously depressing all the ball-ejecting members from their released upper positions to their latched-down lower positions.

A further object of the invention is the provision of a pivoted flipper at the lower region of the playing surface, for propelling a ball in play upwardly along the inclined playing surface, and an actuator, for swinging the flipper, which the child can operate by pounding with his fist or the palm of his hand.

Additional objects and features of the invention will be apparent from the following description in which reference is made to the accompanying drawings.

Figures 1, 4, 6:
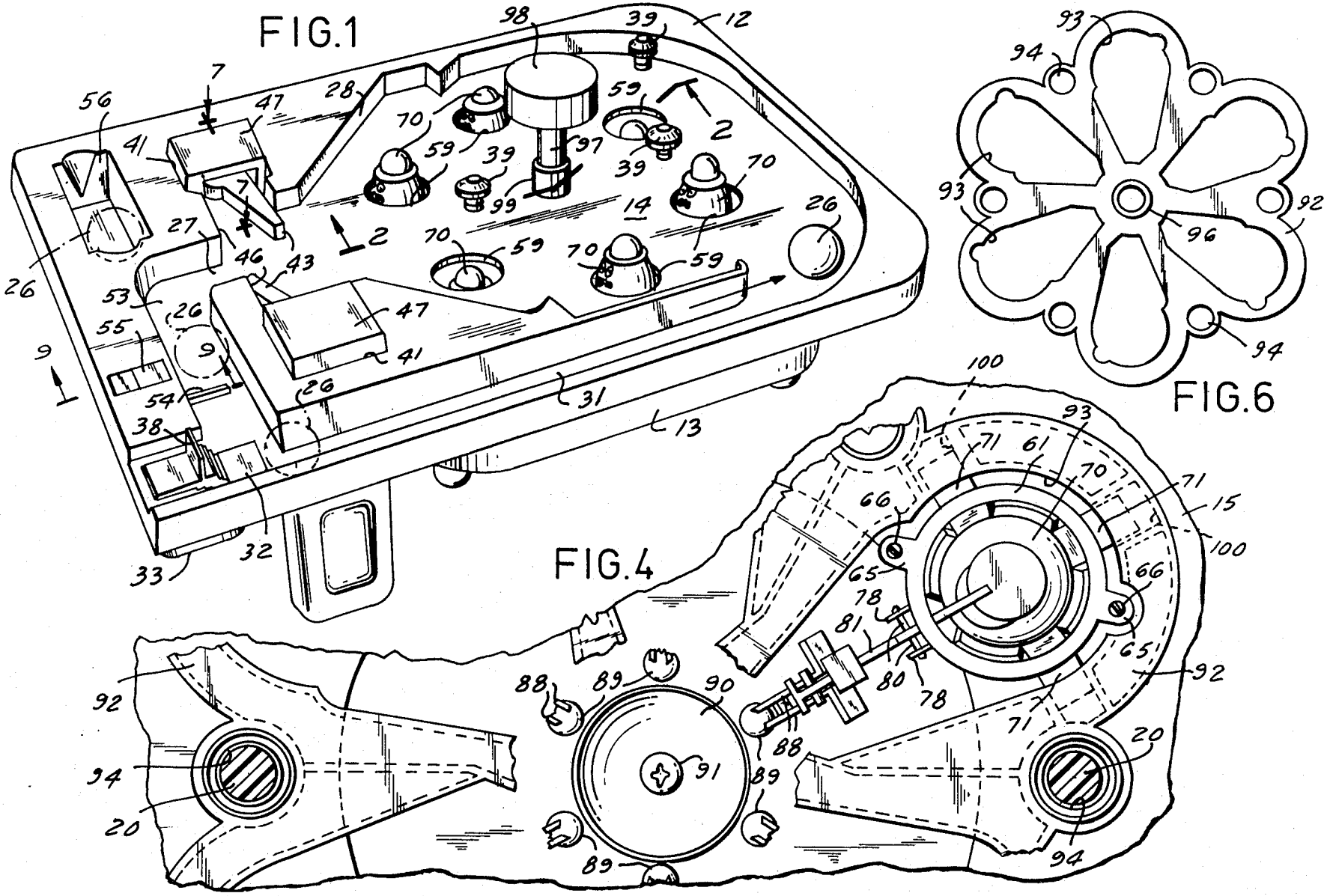
FIG. 1 is a perspective view of a pinball toy according to this invention.
FIG. 4 is a fragmentary horizontal cross-sectional view taken on line 4—4 of FIG. 2.
FIG. 6 is a face view, looking in the direction of line 4—4 of FIG. 2, of the frame for returning all the ball-ejecting members to their lower latched positions.
Figures 2, 9:
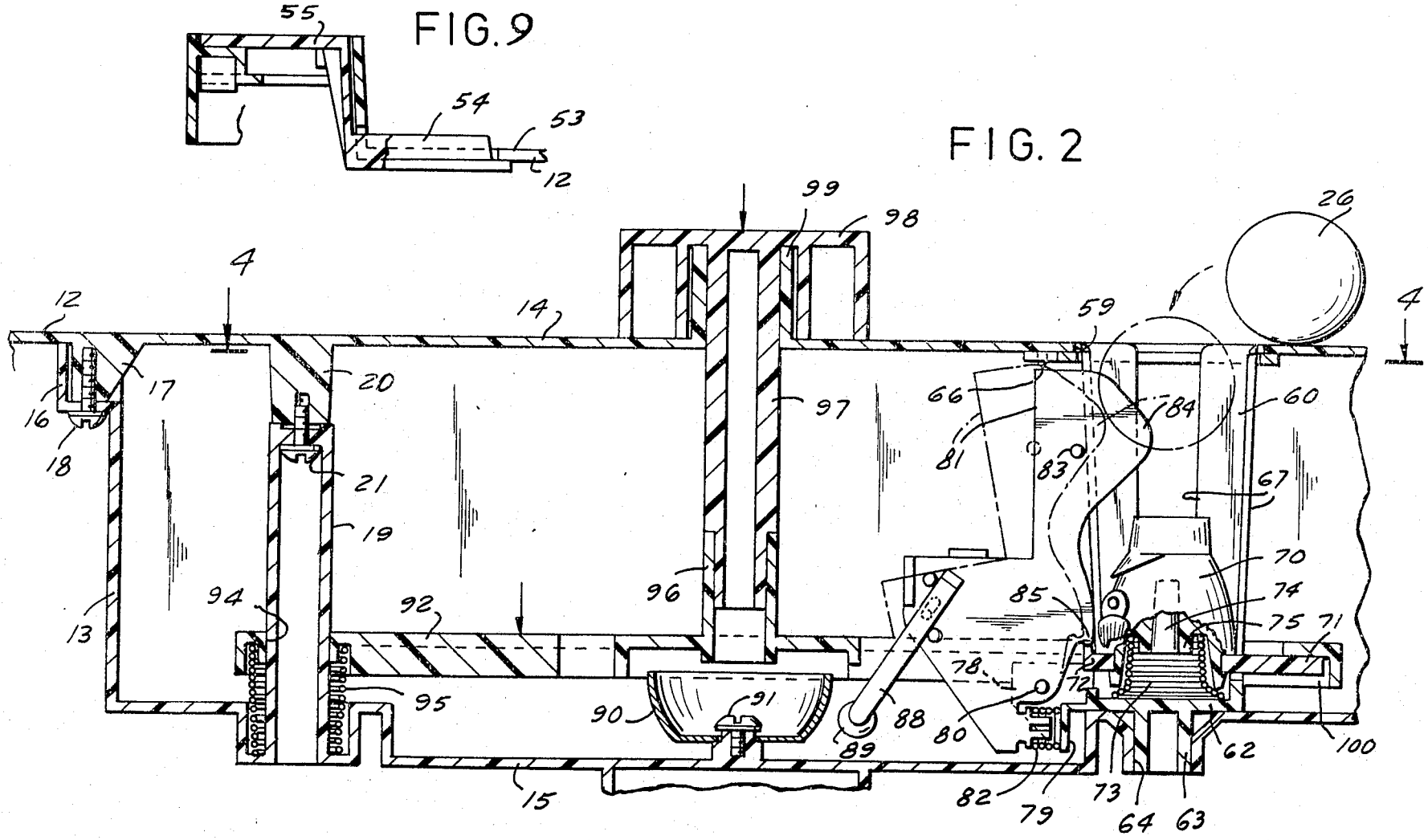
FIG. 2 is a fragmentary cross-sectional view, on an enlarged scale, taken along line 2—2 of FIG. 1.
FIG. 9 is a fragmentary cross-sectional view taken on line 9—9 of FIG. 1.
Figures 3, 9:
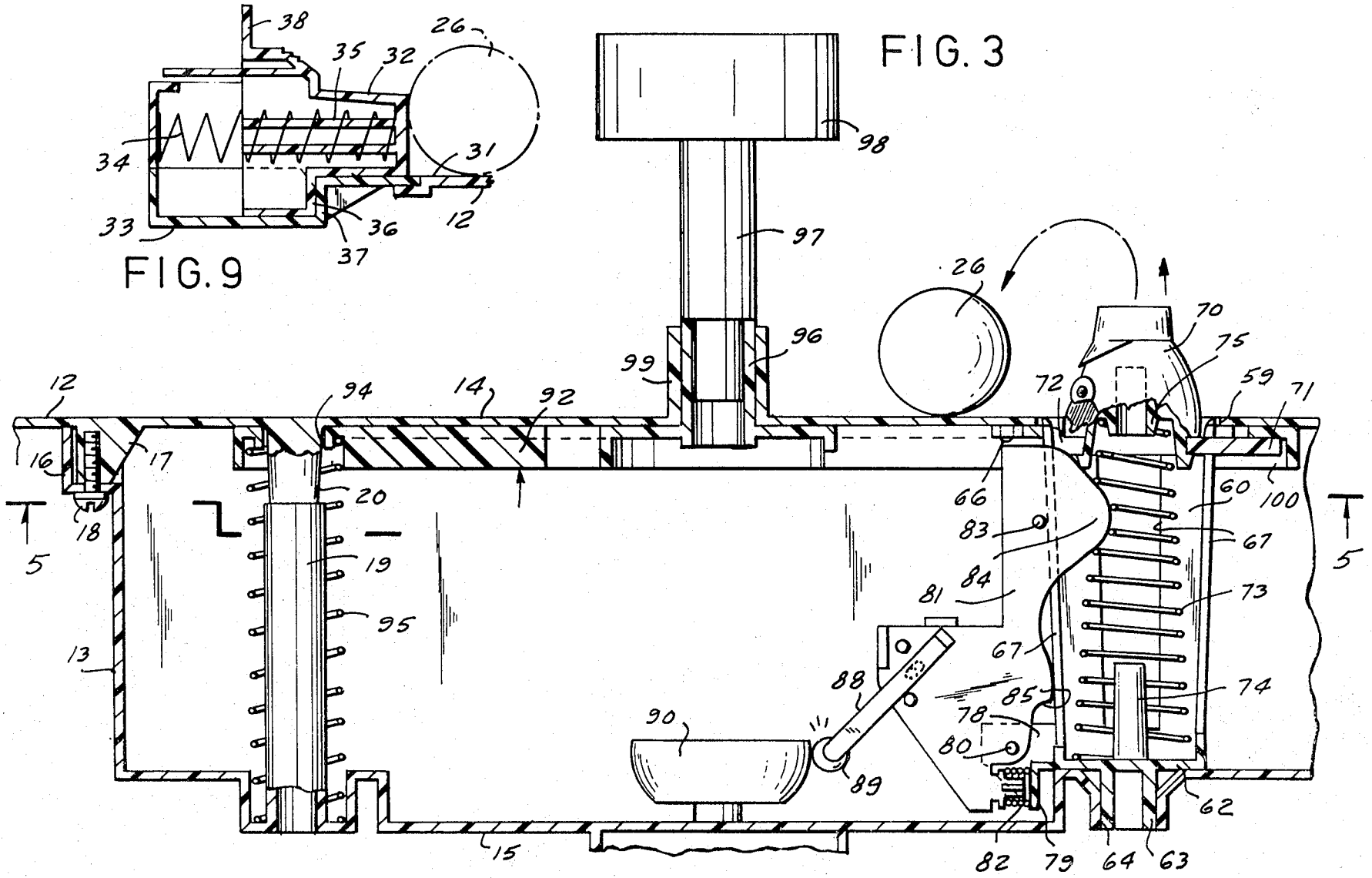
FIG. 3 is a view similar to FIG. 2, but showing some of the parts in different relative positions.
Figure 5:
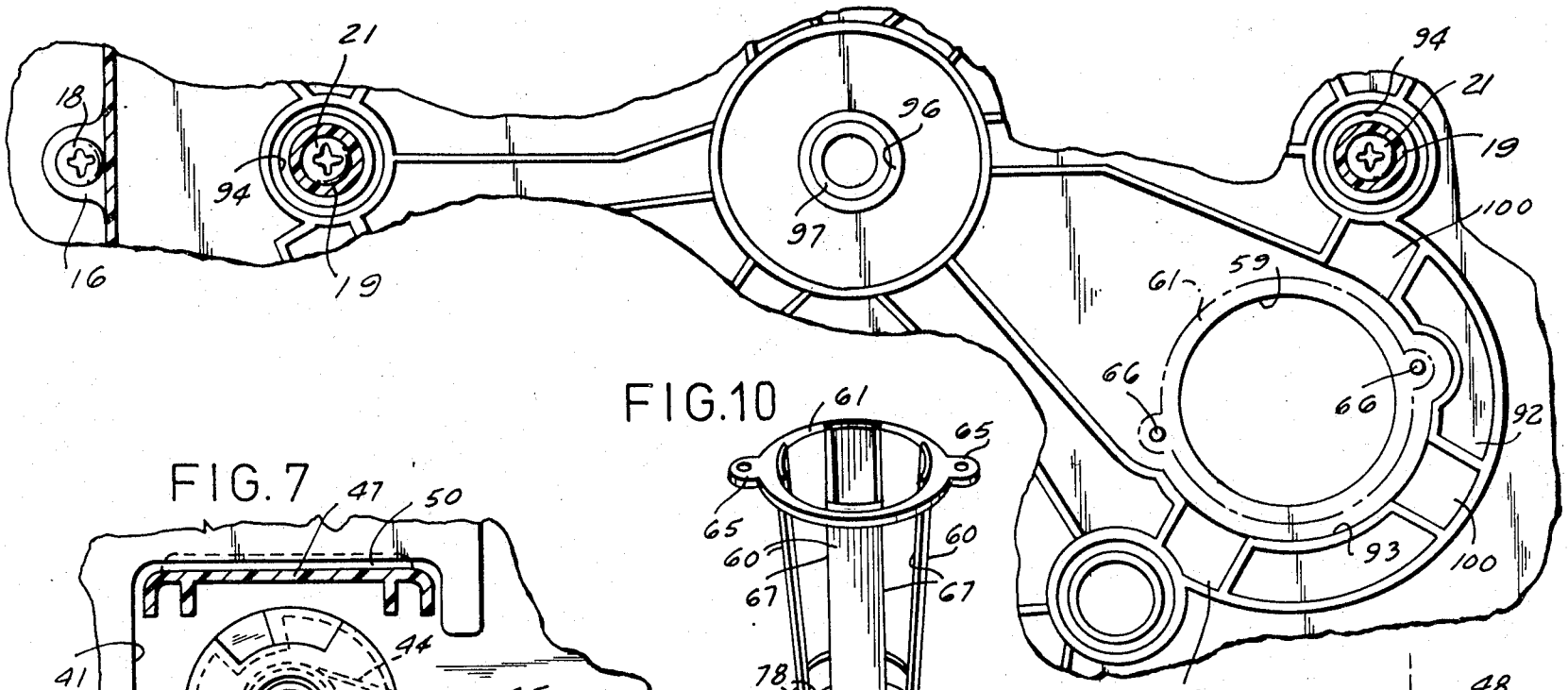
FIG. 5 is a fragmentary horizontal cross-sectional view taken on line 5—5 of FIG. 3.

The pinball toy chosen to illustrate the present invention comprises a generally rectangular platform 12 mounted on a generally square housing 13 (FIGS. 1-3). Platform 12 may be formed of molded plastic, and is shaped to define on its upper surface a generally peripheral raised border enclosing a playing surface 14. Housing 13, which may also be formed of molded plastic, has a bottom wall 15 integral with four upstanding side walls, the open top of housing 13 being closed by platform 12. Projecting outwardly from the upper edge of each of the side walls of housing 13 is an ear 16 (only one being seen in FIGS. 2, 3, and 5) overlying a thickened portion 17 projecting downwardly from the lower surface of platform 12. A screw 18 passes through each ear 16 into portion 17 to secure the platform and housing together. Two relatively tall hollow posts 19 (FIGS. 2–5), projecting upwardly from bottom wall 15 of housing 13, are aligned with two short posts 20 projecting downwardly from the lower surface of platform 12, and a screw 21 joins the posts 19 and 20 end-to-end to further hold the platform 12 and housing 13 together.

The bottom wall of housing 13 is formed with four feet 24 (two being seen in FIG. 1) and two legs 25 (one being seen in FIG. 1) extend downwardly from platform 12. The relative lengths of the feet 24 and legs 25 are such that when the toy is placed upon a horizontal support surface, platform 12 is inclined so that playing surface 14 is higher at its right end, as viewed in FIGS. 1–3, and lower at its left end. As a result, when a ball 26 is introduced on to the higher end of playing surface 14, it rolls by gravity toward the exit 27 located at the lower end of the playing surface. Ball 26 is guided toward exit 27 by two downwardly converging walls 28 formed on the upper surface of platform 12.

The upper surface of platform 12 is also formed with an elongated guideway 31 (FIG. 1) along one side of the platform along which balls, one at a time, are propelled from the lower end of the platform on to the higher end of playing surface 14. At the lower end of guideway 31, platform 12 carries a spring-biased plunger 32 (FIG. 1) for propelling balls 26 along the guideway. Plunger 32 is slidable, within a compartment 33 formed in platform 12, along a line coaxial with the longitudinal axis of guideway 31. A compression spring surrounds an internal post within plunger 32, one end of the spring being seated against a wall of compartment 33 and the other end being seated against a wall of plunger 32, so that the plunger is constantly urged toward guideway 31. Cooperating stepped configurations and of the plunger and compartment, respectively, limit the movement of plunger 32 under the influence of the spring. By means of upstanding handle 38, plunger 32 may be pulled back to compress the spring; when handle 38 is released, plunger 32 is snapped forwardly by the spring, and a ball 26 resting against plunger 32 at the bottom of guideway 31 is propelled upwardly along the guideway on to the high end of playing surface 14. Fixed on the playing surface are a number of bumpers 39 which help to keep the ball in play.

Figure 8:
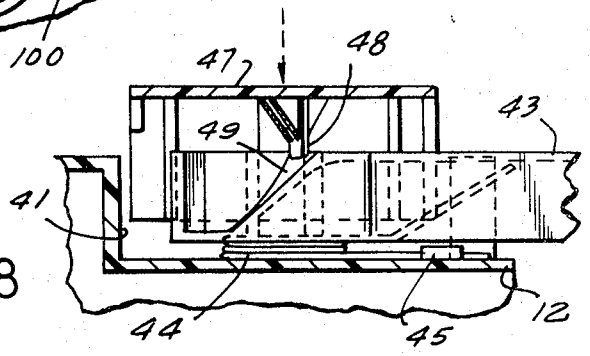
FIG. 8 is a cross-sectional view taken on line 8—8 of FIG. 7.
Figure 10:
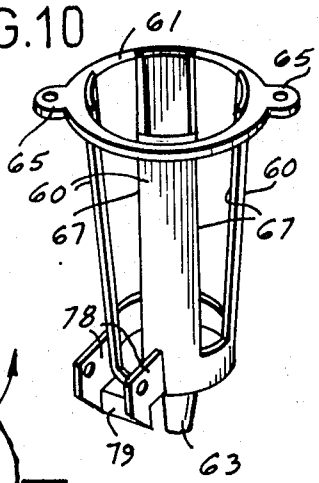
FIG. 10 is a perspective view of a tubular guide located beneath each hole in the playing surface.
Figure 7:
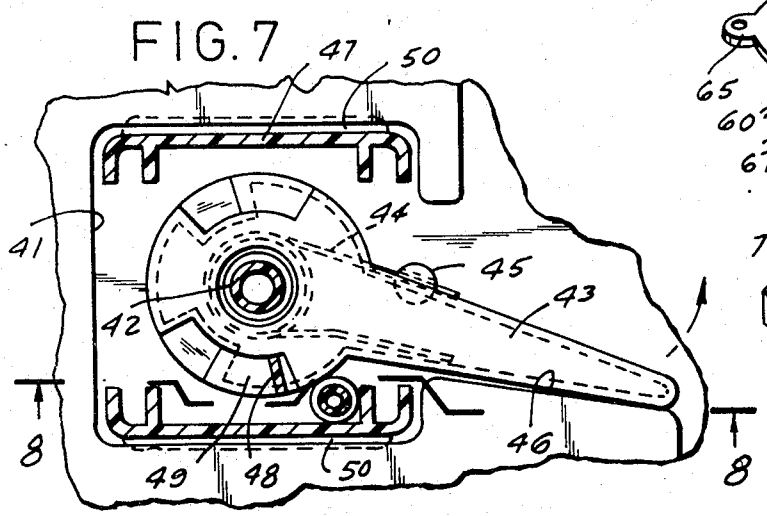
FIG. 7 is a fragmentary cross-sectional view, on an enlarged scale, taken on line 7—7 of FIG. 1.

On each side of exit 27, platform 12 is formed with a square compartment 41 (FIGS. 1, 7, and 8). Within each compartment 41 is a fixed pivot pin 42, projecting upwardly perpendicular to playing surface 14, about which the circular end of a flipper 43 is mounted for swinging movement in a plane parallel to the plane of playing surface 14. A coil spring 44 surrounds pin 42, one end of the spring passing through a hole in bump 45 fixed to platform 12, and the other end of the spring engaging an inner surface of hollow flipper 43, so as to constantly urge each flipper rearwardly against an abutment wall 46. Each compartment 41 accommodates a flipper actuator, in the form of a hollow block 46, slidable perpendicular to the plane of playing surface 14. A cam follower, in the form of a plate 48 having strengthening webs on both sides, projects downwardly from the under side of the top wall of actuator 47. The lower end of cam follower 48 is directly above an upwardly facing sloped cam surface 49 formed on the circular end of flipper 43. Thus, moving actuator 47 downwardly causes follower 48 to slide along sloped cam surface 49 and pivot flipper 43, against the force of spring 44, from its position against wall 46 toward the high end of playing surface 14 (upwardly in FIG. 7). Releasing actuator 47 permits spring 44 to return flipper 43 to a position against wall 46 and to lift actuator 47. Outwardly projecting lips 50 (FIG. 7) at the lower edges of actuator 47 fit within undercuts in the walls of compartment 41 to keep the actuator within the compartment. As a ball rolls along either wall 28 toward exit 27, the child can by actuation of flippers 43 propel the ball back upwardly along playing surface 14. The flippers are very easy to operate, even for young children, since it is merely necessary to bang down on actuators 47 with a fist or the palm of a hand.

Between exit 27 and the bottom of guideway 31, platform 12 is formed with a passageway 53 through which balls can roll to plunger 32 to be propelled again on to playing surface 14. Extending across passageway 53 is a stop 54 (FIGS. 1 and 9) projecting upwardly through a slot in the floor of the passageway. Stop 54 is integral with button 55 exposed on the upper surface of platform 12. By depressing button 55, stop 54 is lowered to the level of the floor of passageway 53, and upon release of the button, the inherent resilience of the stop/button member 54, 55 elevates the stop to its original position. During play, each ball 26 used by a player eventually leaves playing surface 14 through exit 27 and rolls into passageway 53. Stop 54 prevents the balls from rolling to plunger 32, After a player uses all his balls, say three balls, the next player depresses button 55 to lower stop 54 and allow the balls to roll to plunger 32. A cavity 56 is provided in platform 12 for accommodating the balls when the toy is not in use.

Platform 12 is formed, in playing area 14, with a plurality of holes 59 (FIGS. 1–3) each large enough to permit a ball 26 to pass through it. In this example, six holes 59 are shown arranged in a circular pattern. Beneath each hole 59 is a vertically arranged tubular guide 60 (FIGS. 2–4 and 10) comprising an upper ring 61, a downwardly tapered side wall, and a bottom wall 62 from which a locating pin 63 projects downwardly. Pin 63 is snugly accommodated by a hole 64 in bottom wall 15 of housing 13, and two apertured ears 65, projecting outwardly in diametrically opposite directions from ring 61 accommodate two pins 66 extending downwardly from the under surface of platform 12. In this way, tubular guide 60 is maintained in vertical alignment with its respective hole 59. The side wall of guide 60 is provided with four elongated slots 67 equidistantly spaced around the guide.

Slidable longitudinally within each tubular guide 60 is a ball-ejecting member 70 (FIGS. 1–4). Each ball-ejecting member comprises a bulbous upper portion, decorated to look like an amusing face wearing a funny hat, capable of passing through a hole 59. At the bottom if its bulbous portion, member 70 is furnished with three arms 71 projecting radially outwardly, two of the arms projecting in diametrically opposite directions and the third arm projecting at 90° to the other two. Arms 71 are slidably arranged within three of the slots 67 in the side wall of guide 60. A latch keeper or lip 72 (FIGS. 2 and 3) projects from member 70 toward the fourth slot 67 in guide 60. A helical compression spring 73 arranged longitudinally within guide 60 is seated at its lower end against bottom wall 62 of the guide and around a pin 74 projecting upwardly from the bottom wall, and at its upper end adjacent ball-ejecting member 70 and around a hollow boss 75 projecting downwardly from it. Spring 73 constantly urges member 70 upwardly toward the position shown in FIG. 3 wherein member 70 projects through hole 59 above the level of playing surface 14, and arms 71 engage the lower face of ring 61 of guide 60.

At its lower end, guide 60 carries an exterior bracket, aligned with the fourth slot 67 of the guide, having two parallel spaced apart walls 78 (FIGS. 2–4 and 10) and a third wall 79 extending between the other two. Each wall 78 has a hole pivotally accommodating a pin 80 projecting laterally from both sides of a latch member 81. Thus, latch 81 is pivoted about a horizontal axis defined by pin 80. At its lower end, latch 81 is formed with a projection surrounded by a compression spring 82, the spring being seated against bracket wall 79 and constantly urging latch 81 in a clockwise direction in FIGS. 2 and 3. Clockwise movement of the latch is limited by engagement of a pin 83 with the side wall of guide 60, as shown in solid lines in FIGS. 2 and 3. In this position, a nose 84 near the upper end of latch 81 projects through the fourth slot 67 into the interior of guide 60, and a downwardly facing ledge 85 of latch 81 is arranged in the path of movement of latch keeper 72 of ball-ejecting member 70. Thus, if member 70 is pushed downwardly in guide 60 until latch keeper 72 is below ledge 85, the keeper and ledge become interengaged, as shown in solid lines in FIG. 2, and ball-ejecting member 70 is held down against the force of spring 73.

When a ball 26 falls through a hole 59 and enters guide 60, it engages nose 84 and pivots latch 81 counterclockwise, to the position shown in broken lines in FIG. 2. As a result, ledge 85 releases keeper 72, whereupon spring 73 rapidly moves member 70 upwardly to the position shown in FIG. 3. In so doing, member 70 ejects ball 26 from guide 60 and returns it through hole 59 to playing surface 14. Member 70 then remains in its elevated position occupying hole 59, thereby preventing the ball 26, or another ball, from again entering that hole, and also serving as an additional bumper for the balls moving on the playing surface.

Loosely carried by each latch 81 are a pair of strips 88, straddling the latch, formed at their lower ends with a spherical bell striker 89 (FIGS. 2–4). At the center of the circular array of guides 60 is a bell 90 loosely mounted on a short post, projecting upwardly from housing floor 15, by a screw 91. As ball-ejecting member 70 moves upwardly, under the influence of spring 73, past nose 84 of latch 81, the latch is pushed outwardly to its broken line position of FIG. 2. After member 70 passes nose 84, spring 82 snaps latch 81 inwardly until pin 83 strikes guide 60. Movement of latch 81 is thus brought to a jolting halt causing striker 89 to swing outwardly and hit bell 90, as indicated in FIG. 3. Thus, each time a ball 26 falls through a hole 59, that event is followed immediately by the sound of a bell.

Each ball-ejecting member 70 could be individually pushed down manually from its elevated position (FIG. 3) to its latched position (FIG. 2). However, the present invention provides for simultaneously returning all six members 70 to their latched positions. For this purpose, a generally circular frame 92 (FIGS. 2–6) is furnished, having six lobes. An opening 93 is provided in each lobe, each opening accommodating one of the tubular guides 60. A hole 94 is provided between each two lobes, two of the holes 94 slidably accommodating, respectively, the two pairs of posts 19, 20 so that frame 92 is slidable vertically along posts 19, 20. A compression spring 95 surrounds each post 19, the lower end of the spring seating against bottom wall 15 of the housing and the upper end of the spring seating against the lower face of frame 92. Springs 95 constantly urge frame 92 upwardly and hold it against the lower face of platform 12, as shown in FIG. 3.

At its center, frame 92 is formed with a hollow tube 96 within which is fixed the lower end of a rod 97 carrying a handle 98 at its upper end. Tube 96 and rod 97 are slidable within a hollow boss 99 formed integrally with platform 12. By pushing downwardly on handle 98, frame 92 can be moved, against the force of springs 95, from its elevated position shown in FIG. 3 to its lowered position shown in FIG. 2.

Each lobe of frame 92 is formed in its lower surface with three generally rectangular depressions 100 (FIGS. 4 and 5), all of which project radially outwardly from the opening 93 in that lobe, and are adapted to accommodate the three arms 71 projecting radially from ball-ejecting member 70. Consequently, as frame 92 is moved downwardly, by depressing handle 98, the frame pushes downwardly on arms 71 and thereby simultaneously moves all the ball-ejecting members 70 downwardly. Downward movement of frame 92 continues until it reaches the position shown in FIG. 2, wherein the keeper 72 of each member 70 snaps beneath the ledge 85 of its respective latch 81. Handle 98 is then released, whereupon springs 95 return frame 92 to its elevated position (FIG. 3), but members 70 remain in their latched down positions until balls 26 enter holes The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A pinball toy comprising:

(a) an inclined playing surface, (b) a plurality of holes in said playing surface, (c) a ball sized to pass through said hole, (d) means for introducing said ball on to the higher portion of said playing surface, (e) a ball-ejecting member below said playing surface in alignment with each hole, each ball-ejecting member being sized to pass through its respective hole, (f) independently operable means responsive to passing of said ball downwardly through each hole for causing said ball-ejecting member associated with that hole to pass upwardly through said hole and return said ball to said playing surface, at least a portion of said ball-ejecting member remaining above said playing surface until it is manually depressed to a position below said playing surface, and (g) manually operable means for simultaneously returning all of said ball-ejecting members to positions below said playing surface.

2. A pinball toy as defined in claim 1 including at least one flipper at the lower region of said playing surface, said flipper being pivotal about an axis perpendicular to said playing surface and movable in a plane parallel to said playing surface, a manually operable flipper actuator movable perpendicular to said playing surface, and means responsive to movement of said flipper actuator toward said playing surface for pivoting said flipper in a plane parallel to said playing surface.

3. A pinball toy as defined in claim 2 wherein said means responsive to movement of said flipper actuator includes an inclined cam surface carried by one of said flipper and actuator, and a cooperable cam follower carried by the other.

4. A pinball toy as defined in claim 1 wherein each of said responsive means includes a spring constantly urging said ball-ejecting member upwardly through said hole.

5. A pinball toy as defined in claim 4 wherein each of said responsive means includes latch means for maintaining said ball-ejecting member below said playing surface against the force of said spring, and means operated by said ball as it passes downwardly through said hole for releasing said latch means to permit said spring to move said ball-ejecting member upwardly.

6. A pinball toy as defined in claim 5 wherein said latch-release means includes a nose beneath said playing surface in the path of downward movement of said ball through said hole.

7. A pinball toy as defined in claim 5 including means carried by said latch means for sounding a bell each time said latch means is released.

8. A pinball toy comprising:

(a) an inclined playing surface, (b) at least one hole in said playing surface, (c) a ball sized to pass through said hole, (d) means for introducing said ball on to the higher portion of said playing surface, (e) a tubular guide beneath said playing surface and aligned with said hole, said ball falling into said guide after passing through said hole, (f) a ball-ejecting member below said playing surface and slidable axially within said guide, said ball-ejecting member being sized to pass through said hole, (g) means responsive to passing of said ball downwardly through said hole for causing said ball-ejecting member to pass upwardly through said hole and return said ball to said playing surface, at least a portion of said ball-ejecting member remaining above said playing surface until it is manually depressed to a position below said playing surface, (h) said responsive means including a compression spring axially arranged within said guide beneath said ball-ejecting member, and a latch pivotally mounted on the exterior of said guide, and (i) an opening in the side wall of said guide through which said latch engages said ball-ejecting member to hold the ltter down against the force of said spring.

9. A pinball toy as defined in claim 8 wherein said latch carries a nose extending into the interior of said guide for engagement by a ball falling into said guide, engagement of said ball with said nose producing pivotal movement of said latch so that it releases said ball-ejecting member.

10. A pinball toy comprising:

(a) an inclined playing surface, (b) at least one hole in said playing surface, (c) a ball sized to pass through said hole, (d) means for introducing said ball on to the higher portion of said playing surface, (e) a tubular guide beneath said playing surface and aligned with said hole, said ball falling into said guide after passing through said hole, (f) a ball-ejecting member below said playing surface and slidable axially within said guide, said ball-ejecting member being sized to pass through said hole, (g) means responsive to passing of said ball downwardly through said hole for causing said ball-ejecting member to pass upwardly through said hole and return said ball to said playing surface, at least a portion of said ball-ejecting member remaining above said playing surface until it is manually depressed to a position below said playing surface, (h) at least one elongated slot in the side wall of said tubular guide and extending in an axial direction, at least one arm projecting from said ball-ejecting member through said slot, said arm being slidable longitudinally along said slot, and (i) means manually movable in an axial direction along the exterior of said guide for engaging said arm and moving said ball-ejecting member downardly in said guide.

* * * * *